United States Patent [19]

Koptis et al.

[11] Patent Number: 4,759,298

[45] Date of Patent: Jul. 26, 1988

[54] SMOKELESS PYROLYSIS FURNACE WITH SINGLE THERMOCOUPLE, AND RAMP AND SOAK TEMPERATURE CONTROL SYSTEM

[76] Inventors: Robert A. Koptis, 15963 Remora Blvd., Brookpark, Ohio 44142; Robert F. Heran, 1842 Donna Dr., Westlak, Ohio 44145

[21] Appl. No.: 25,889

[22] Filed: Mar. 16, 1987

[51] Int. Cl.[4] ..... F23N 5/02

[52] U.S. Cl. ..... 110/190; 110/210; 110/236; 110/346

[58] Field of Search ..... 110/190, 236, 193, 210, 110/212, 214, 346

[56] References Cited

U.S. PATENT DOCUMENTS

| | | | |
|---|---|---|---|
| 3,807,321 | 4/1974 | Stockman | 110/236 |
| 4,181,081 | 1/1980 | Weber | 110/236 X |
| 4,557,203 | 12/1985 | Mainord | 110/190 X |

*Primary Examiner*—Edward G. Favors

*Attorney, Agent, or Firm*—Alfred D. Lobo

[57] ABSTRACT

A batch-type pyrolysis furnace fired by a main heat source such as a gas burner or an electric heating coil in combination with an afterburner to burn volatiles generated in the furnace's main chamber, is operated to incinerate high-polymer loads smokelessly, yet is effectively safeguarded from explosions. A single thermocouple (zone TC) senses the instantaneous temperature in a critical sensitive zone (CSZ) of the furnace and in cooperation with a programmable controller (PC), maintains a preselected ramp and soak temperature profile over the entire burn cycle. The CSZ has been found to be within about 1' (foot) from the upper edge of the throat, and not lower than about 6" (inches) from the ceiling of the main chamber. When the temperature required by the profile is exceeded, a single water spray actuated by a signal from the PC lowers the temperature below the profile. The zone TC thus maintains a fire under controlled temperature conditions in the main chamber without an explosion, using a single TC in the control system.

6 Claims, 3 Drawing Sheets

SMOKELESS PYROLYSIS FURNACE WITH SINGLE THERMOCOUPLE, AND RAMP AND SOAK TEMPERATURE CONTROL SYSTEM

BACKGROUND OF THE INVENTION

This invention relates to a control system for a batch-type pyrolysis device of the type used for volatilizing and burning organic material from a metal part to which the organic material is bonded. Incineration occurs in a zone adjacent to the device's main chamber in which the material is volatilized. Such an incineration zone is typically provided by an afterburner chamber in which an afterburner, positioned downstream of the device's main chamber in which pyrolysis occurs, burns the volatilized organic material (referred to herein as "vapor"). The remaining metal part is reclaimed for reuse because the cost of reclamation is less than that of making the metal part anew. Such reclamation by pyrolysis has evolved into a subindustry of considerable economic significance not only because pyrolysis is cost-effective, but also because incineration of the vapor of polymeric materials which are not economically recyclable, conveniently and beneficially disposes of them.

A highly successful control system for a pyrolysis furnace in which incineration occurs in the main chamber and also downstream of the afterburner is provided in our U.S. Pat. No. 4,649,834. This system uses a single water spray system controlled by a first thermocouple (TC) in the main chamber (main chamber TC), a second thermocouple in the stack (stack TC) which controls only on/off or attenuated operation of the main burner and a third thermocouple (throat TC) in the vent passage ("throat") connecting the main chamber to the afterburner chamber. The effectiveness of this control system, in large measure, derives from the difference in temperatures sensed by the first and third thermocouples.

This invention is specifically directed to burning relatively large loads of metal parts combined with silicone-free polymers ("burnables") which are to be incinerated smokelessly in a relatively small main chamber, that is, with a relatively high ratio of load (lb)/volume ($ft^3$), referred to as the load/volume ratio. Such loads contain from 0.1 lb of burnables per lb of metal, to 2 lb burnables/lb metal, and are referred to as "high-polymer" loads in contrast to conventional loads which contain less than 0.1 lb burnables/lb of metal.

The term "pyrolysis oven" has been used in the art to indicate that there is no incineration of organic material on the metal parts within the oven's main chamber. The material is simply volatilized (or vaporized) without being burned in the oven's main chamber. The vapors are then burned in the afterburner chamber, but not before they have exercised the opportunity to plug water spray nozzles used to keep the volatilization of burnables in the main chamber under control. Such operation of a "pyrolysis oven", where there is no fire in the main chamber, is supposed to clearly distinguish its function, from that of a "pyrolysis furnace" in which there is. Nevertheless, the terms are often misused or interchanged, particularly in relation to devices using an afterburner in an afterburner chamber of the furnace, with no thought given as to the significance of where the fire is maintained.

It was found that with high-polymer loads loads with the above-specified burnables content, the rise of temperature in the initial portion of the burn cycle was often uncontrollable, resulting in dense smoke and excessive temperatures in the main chamber. This occurred even when the furnace is constructed with a "vent number" greater than 0.003/ft found to be critical for normal operation. The vent number is computed by dividing the area of the vent (throat, $ft^2$) by the volume of the main chamber ($ft^3$).

In our copending patent application Ser. No. 881,953 filed July 3, 1986, we provide a pyrolysis furnace which generates a smokeless discharge into the atmosphere under normal conditions of commercial operation—a characteristic of operation not duplicated in any prior art device we know of. By "discharge" we refer to combustion products issuing from the furnace's stack, and by "smokeless" we refer to the discharge being substantially clear to the naked eye, that is, permeable to light in the visible wavelength range.

The problem with our above-identified systems is that, to ensure a high degree of safety of operation, and to minimize the danger of an explosion, it was necessary to use plural thermocouples (TCs). The redundant safety provided by the additional TCs was far more essential than tests originally indicated, the single TC in the throat being simply unable to provide as large a margin of safety as is desirable. The location (in the throat) of the essential TC was arrived at from earlier experimentation which resulted in our use of a combination of three thermocouples (our '834 patent), but safe operation with a single TC in the throat, required operation of the furnace with more care than is likely to be provided by unskilled operators. Particularly because the location of one TC in the throat was also maintained in a three-thermocouple system used in our copending application Ser. No. 881,953, it appeared unlikely that both, close control over the temperature of the parts as well as a high enough degree of safety might be predicated upon repositioning the throat TC.

Moreover, the problem of maintaining the calibration of plural TCs, not to mention the cost of installing them, provided the incentive to dispense with all but one of the TCs. But it was difficult to believe that re-positioning the throat TC could make the big difference—after all, we had reason to believe that we had already placed the TC in the most advantageous location, namely in the throat. It was therefore with considerable surprise that we learned from measurements we made, that the most sensitive location for a single TC was in a zone outside, but proximately disposed relative to the throat, in the uppermost part of the main chamber, no more than about 1 foot from the upper edge of the throat, regardless of the size of the main chamber, provided other explosion-defeating design criteria were preserved. This zone is referred to herein as the "critical sensitive zone" or "CSZ" for brevity. These other design criteria are more fully described in our '834 patent and copending application Ser. No. 881,953, both the disclosures of which are incorporated by reference thereto as if fully set forth herein.

The vapor to be incinerated is generated when mounting means for engines and electric motors (collectively referred to as "motor mounts"), and similar steel parts bonded to rubber; or, copper-containing electrical parts such as armatures, stators, transformers and the like; or, painted ferrous or non-ferrous steel parts; or, metallic bodies of arbitrary shape which are coated with, or bonded to polymeric materials (referred to herein as "polymer-bonded metal parts"), are to be pyrolized in a pyrolysis furnace.

Polymeric materials to be disassociated from metal parts are such materials as are commonly bonded to a metal substrate or matrix and include natural and synthetic elastomers; for example, natural rubber and synthetic rubber which are polymers of dienes; silicones which are polymers of siloxanes and the like; and, natural and synthetic resinous materials including natural shellac and synthetic plastics such as phenolics and acrylics, particularly paints. The difficulty of incinerating the materials smokelessly varies; silicones do not burn smokelessly, but silicone-free rubbers and paints can now be reliably and economically incinerated, and smokelessly.

The foregoing polymeric materials are to be separated from the metal matrix to which they are bonded without melting the metal, and preferably, in most instances, without causing warpage or other undesirable deformation of residual metal matrix. It is self-evident that such separation may be effected by directly incinerating the polymeric materials, as is typically done in an incinerator for waste, but it is equally self-evident that the requirement of incineration without damaging the metal parts will not be met. Of course, damage to the parts can be minimized if only a few parts are incinerated together, but this method is undesirable because it does not lend itself to reclaiming a large enough mass of parts to be economical.

The desirability of a smokeless discharge from the stack of a pyrolysis furnace cannot be overemphasized. It is common practice to operate such a furnace during the day in such a manner that the smoky discharge is not too objectionable, reserving such operation for darkness. More responsible operators provide plural afterburners in series to make sure that as complete combustion as possible is obtained. The seriousness of the problem is such that even in a drying furnace where a relatively small amount of contaminating oil is being burned, plural burners are used, as disclosed in U.S. Pat. Nos. 3,767,179 and 3,839,086 to Larson.

Where the weight ratio (weight of burnables to be burned): (weight of metal) is relatively high, that is in the range from 0.1:1 to 2:1, a manufacturer of a prior art furnace advises against burning such loads. Attempts to burn even a small load result not only in the discharge of a highly noticeable stack gas, but also in the severe fouling of the furnace's main chamber, the controls, and, most important, of the water nozzles upon which the safe operation of the furnace is critically dependent.

An attempt to deal with the problem of fouling water spray nozzles is found in U.S. Pat. No. 4,557,203 to Mainord who uses a first sensor in the stack downstream of the afterburner to actuate a first set of nozzles; and a second sensor in the main chamber to actuate a second set of nozzles.

Prior to our invention (in the 881,953 application) we did not realize that the sensitivity of the throat thermocouple is such that, a controlled rate at which the temperature of the load is raised ("ramped") can control a burn so effectively as to provide a smokeless stack even when burning a load of high-polymer parts. And most important, that the entire burn cycle may be controlled with the throat TC, so that the main chamber TC and the stack TC are used to provide only redundant safety of operation. Thus we were also unaware that there existed a critical location for the main chamber TC which not only could replace the function of the throat TC, but would do so with such safety that the other thermocouples couldbe eliminated.

This invention is specifically directed to a pyrolysis furnace with a single thermocouple, located in the CSZ, and peculiarly sensitive to the temperature generated by a fire sustained in the furnace's main chamber. The temperature is ramped to preselected progressively higher setpoints with optional intervening soak intervals, after which the temperature is maintained constant during a final load-cleaning burn (referred to as the "final soak period"). The surprising result is that there is essentially no visible smoke issuing from the stack, and no runaway increase of temperature.

A charge of metal parts on a cart is charged to the main chamber, the charge is brought up to ignition temperature at a predetermined rate which is controlled by a programmable control means, ignited, and the fire sustained under controlled "ramp and soak" conditions until the charge is burned out.

It is known that heating of the metal parts to 700°-800° F. in an enclosure with limited air intake will char or degrade all known combustible contaminants without ignition if the percentage of contaminants is less than about 2% by weight ("wt") of the parts. However, we are concerned with igniting much higher amounts of combustibles in the range from about 10% by wt of the load in the charge to about twice the weight of the load, or even more, and it is critical that the ignition result in an essentialy smokeless stack.

It is unnecessary to point out that, when operating under near-explosive conditions and a very small misstep can set off an explosion, a smokelesss stack may be an exiguous consideration. But any control system which provides a smokeless stack, yet prevents such an explosion from being set off, acquires great merit. In other words, a smokeless furnace must be operated with no sacrifice of safety. Our invention does so.

A reclamation oven with a control system for preventing fires and explosions and thus controlling excess temperature within it, is disclosed in U.S. Pat. No. 4,270,898 to Kelly. The fire and explosion control method senses a fire situation before it occurs, and keeps the fire from happening by instituting a timely extinguishing system. A thermocouple is installed in the exhaust, downstream from the afterburner, and when the temperature exceeds a preset temperature, a signal from the thermocouple actuates an automatic valve assembly to open it and spray water onto the too-hot parts in the main chamber. When the parts cool sufficiently, the valve assembly closes. The system prevents fires and explosions and thus controls excess temperatures. The main burner is not shut off when the water spray comes on, though the main burner goes off when the oven reaches the set-point temperature, nor is the average temperature above the metal parts in the oven's main chamber (referred to as the "ambient temperature" in the main chamber) monitored. It is evident that the possibility that a temperature monitored at some location in the main chamber might be a critical factor in the control of the operation of the furnace, escaped the patentee. Moreover, this prior art system, in which a fire in the main chamber is prevented, is wholly ineffective to minimize the smoke issuing from the stack, and as Mainord states, is responsible for plugging water nozzles. It is quite unlike our system in which a fire is maintained under conditions imposed by alternately ramping temperature, then maintaining it constant ("soaking").

Another system relating to incineration of unwanted organic material such as oil associated with metal parts, particularly scrap or swarf, is disclosed in U.S. Pat. No. 3,705,711 to Seelandt et al. Only as much air and fuel as is required to fuel the main burner, is burned to minimize oxidation of the metal parts and to minimize the risk of explosion. It is evident that such conditions of operation are calculated to generate more smoke because of incomplete combustion, not minimize the smoke generated. Control is provided by limiting the amount of combustion air to the main chamber when a preset pressure is exceeded. It is suggested that the temperature within the drum may first be lowered by throttling back the main oil burner or by stopping the feeding of metal scrap into the dryer drum, though it appears that control of the temperature is only a secondary consideration, there being no indication that the degree of control might be affected by where the temperature was measured. When the main burner output is reduced to its lower limit and the temperature within the drum is still too high, a water spray may be actuated. Should the spray be insufficient to lower the temperature, the feeding of the scrap into the drum is reduced or stopped. The problem is that the time period required for these operations is much longer than that permitted by conditions under which an explosion occurs because of ignition of the built-up vapor. As a result, such a system is wholly unsatisfactory under the conditions of operation of a pyrolysis furnace.

The control system of our invention allows the safe and smokeless burn of a high-polymer load by controlling a single stage of the burn cycle, namely the ramping stage. Control of the temperature in the CSZ, with a single TC and PC to track the ramp and soak profile, and actuate an intermittent water spray as required, is the only essential requirement of our single-stage system.

No prior art control system for a pyrolysis furnace recognized the importance of controlling temperature in a CSZ, for safe operation which produced a smokeless discharge.

SUMMARY OF THE INVENTION

It has been discovered that there exists a small zone, referred to as the critical sensitive zone ("CSZ"), immediately above a horizontal line drawn through the upper edge of the throat in the main chamber of a pyrolysis furnace, and within about 1 foot from the upper edge of the throat, in which CSZ the temperature of the main chamber is highest; and, that controlling the ramping of temperature in the CSZ with a single thermocouple (TC), along with the duration of any subsequent soak period, will produce a smokeless stack gas with an improvement in operational safety. The furnace is typically fired by a main gas burner and an afterburner burning in the presence of excess oxygen. A programmable controller means sets the ramp, that is, the instantaneous critical temperature in the CSZ as a function of time, and actuates a water spray at any time when the temperature required is exceeded.

More specifically, it has been discovered that excellent operational safety and a smokeless stack are provided by controlling a single stage, namely the ramping stage, of a burn cycle with a single TC in the CSZ. The effectiveness of the control system derives from the critical placement of the single TC which effectively controls the ramping portion of the burn cycle, which unexpectedly also provides a smokeless burn.

It is therefore a general object of this invention to provide, in a pyrolysis furnace having a main chamber, a main gas burner directly to heat air ducted into the chamber, a throat near the top of the main chamber through which throat organic vapor volatilized by incineration of polymer-bonded metal parts leaves the main chamber, an afterburner chamber provided with an afterburner to incinerate said organic vapor downstream of the throat, an exhaust stack through which incinerated vapor is vented, a single TC (zone TC) located within the main chamber to sense the ambient temperature of gases above the metal parts within the chamber, the improvement comprising, said zone TC located in the critical sensitive zone (CSZ) upstream of said afterburner, to sense the instantaneous critical temperature in said zone;

programmable temperature control means which requires a predetermined temperature ("required temperature") as a function of time operatively connected with said zone TC; and, water spray means responsive only to said zone TC when the temperature in the CSZ exceeds said predetermined instantaneous critical temperature in the zone is in the range from about 600° F. to 1100° F. at a predetermined time, so that water is sprayed into the main chamber, above said metal parts, to lower the temperature in the CSZ to said required temperature;

whereby said incinerated vapor leaving said exhaust stack is permeable to light in the visible wavelength range.

It is a specific object of this invention to provide a pyrolysis furnace with a smokeless stack by (i) maintaining a fire in a high-polymer load of metal parts being pyrolized under a controlled ramped temperature during the initial stage of the burn cycle, and, (ii) sensing the temperature in said zone with a single TC in the CSZ and obtaining a required temperature as a function of time, which temperature, if exceeded, actuates a water spray in the main chamber to cool the burning load, so that combustion gases from the stack are essentially smokeless.

DESCRIPTION OF THE DRAWINGS

The foregoing and other objects and advantages of my invention will appear more fully from the following description, made in connection with the accompanying drawings of preferred embodiments of the invention, wherein like reference characters refer to the same or similar parts throughout the views and in which.

DETAILED DESCRIPTION OF PREFERRED EMBODIMENTS

The most preferred embodiment of the invention derives from the use of a programmable controller means ("PC") to provide a predetermined controlled temperature ramp in a temperature profile monitored by a TC in the throat. The required ramp may consist of a single ramp, or plural ramps, and the one or more ramps may be executed with no soak periods, if a soak period is unnecessary, or plural soak periods. It is preferred to use a PC with about 4 ramps and 4 soak periods, though a particular profile may use only a single ramp and from 0 to 4 soak periods. It is critical that the sensing means for the ramp profile be in the critical sensitive zone. In addition, the furnace is constructed with an adequate vent number to minimize the risk of explosions, as was disclosed in our '834 patent and copending application Ser. No. 881,953.

Figure 1:
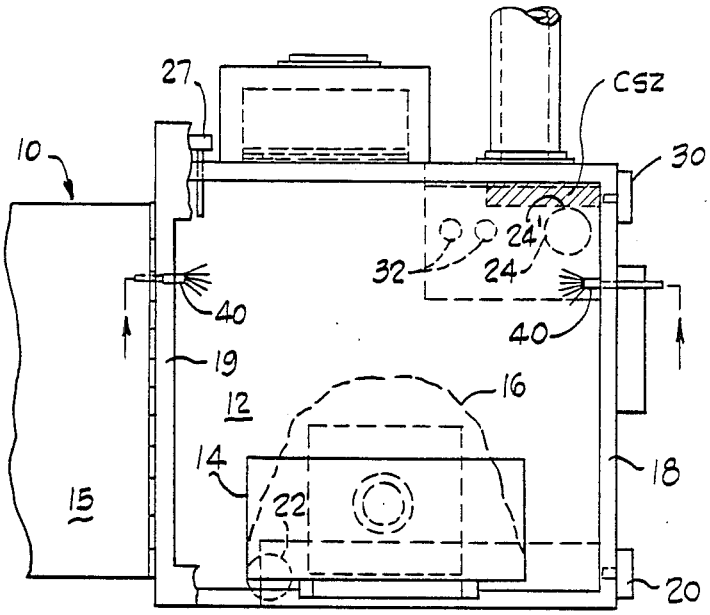
FIG. 1 is a front elevational view of a schematically illustrated pyrolysis furnace, with an open front door shown broken away, the operation of which furnace is controlled by the single TC and temperature control system of this invention.

The furnace and control system for its operation is diagrammatically illustrated in FIG. 1 which is a front elevational view of a pyrolysis furnace, indicated generally by reference numeral 10, which is typically a large structure shaped like a rectangular parallelpiped though the shape is not especially relevant to the function of the furnace. Within the furnace is a main chamber 12 onto the floor 13 of which a cart 14 is rolled through a door 15. The cart is loaded with polymer-bonded metal parts 16 to be pyrolized. The door 15, shown in the open position with a portion broken away, is in the front of the furnace which has a rear wall 17, right side wall 18 and left side wall 19. The door is gasketed with a suitable high temperature material to seal the main chamber during operation, and the interior surface of the door, like the interior of the main chamber, is insulated with ceramic fiber. After one load or charge is subjected to a pyrolysis or "burn-off" cycle, another is introduced into the chamber and the cycle is repeated, which is why the furnace is referred to as a "batch" pyrolysis furnace.

At the far end of the chamber from the door, and behind the rear wall, is provided a direct heating means for air in the form of a main burner assembly, indicated generally by reference numeral 20, which includes a main burner removably inserted in a main burner firebox 21, air regulating means (not shown) to adjust the air flow to the burner, and associated hardware (not specifically shown) all of which is conventional and commercially available. The particular type of direct heating means for supplying hot air is not critical so long as it can provide enough heat to ignite the polymer on the metal parts once they have been brought up to temperature in the main chamber. Most preferred is a main burner which burns natural gas fuel to produce an elongated flame which is adjusted to extend along substantially the entire length of the base of the rear wall 17 of the chamber. Hot combustion gases generated by the main burner flow into the main chamber through a burner passage 22 in rear wall 17. The burner passage 22, places the main chamber in open communication with the main burner firebox. The flame is adjusted to extend the length of the firebox with the tip of the flame playing at passage 22, the cross-sectional area of which is substantially the same as that of the sheath so that there is no significant restriction of circulation of the hot gases generated by the main burner. This ensures igniting the charge after it reaches ignition temperature.

The type of main burner chosen depends upon the size of the charge and chemical composition of the polymer to be "burned", and the time constraints for doing so. For a typical main chamber having a width of 4 ft., a length of 4 ft., and a height of 4 ft., within which a charge of about 500 lb of motor mounts (25% by wt is rubber) are to be burned, an Adams Model 225 burner having a rated output of 100,000 BTU/hr is used. The load/volume ratio is about 7.8 lb/ft$^3$; and the burnables/metal ratio is 0.25. Operable load/volume ratios range from about 0.5 to about 15 lb/ft$^3$, it being readily realized that the lower ratio is not narrowly critical while a ratio higher than the upper ratio leads to an inoperative furnace.

This burner may be adjusted to throw a flame about 3 ft long, and the air intake to the burner can be controlled to ensure that the fuel burns with an excess of oxygen.

In the rear wall 17, and near the top thereof, diagonally from the burner passage 22, is a throat 24 through which hot gases generated in the main chamber leave it. The throat 24 places the main chamber 12 in open communication with an afterburner chamber 26 in which an afterburner assembly 30 is removably inserted. The assembly 30 includes an afterburner, means for regulating the amount of natural gas burned, means for regulating the air flow to the burner, and associated hardware (not specifically shown) all of which are commercially available, for example in an Adams HP BPS burner (output 400,000 BTU/hr) assembly. The afterburner is adjusted to throw an elongated flame. All gases which leave the main chamber must flow through the throat 24 and come in contact with the afterburner flame in the afterburner chamber.

The diameter of the throat 24 is sized so as to provide a predetermined draft, whether natural or forced, in the main chamber during operation of the furnace. The type of polymer burned, the weight of polymer present on each charge, the volume of the main chamber, and the time in which each cycle is to be completed (that is, the charge is to be introduced, brought up to temperature, burned and cooled enough to withdraw the cart from the main chamber), inter alia, will determine the area.

In particular, when the mass flow rate of hot gases and vapor through the throat 24 exceeds a critical venting flow rate there is a rapid build-up of pressure, which build-up, if continued, results in an explosion. To avoid the explosion, the quantity "(area of the throat 24)/(volume of the main chamber 12)" must exceed 0.003/ft but preferably not exceed 0.015/ft. This quantity is referred to as the critical vent number.

For example, a furnace with a 4'(ft)×4'×4' main chamber required to burn a charge of about 500 lb of motor mounts consisting of 400 lb of steel and about 100 lb of rubber in a 6 hr cycle, requires a vent larger than 0.5 ft in diameter. The vent is too large when a desirable draft to ensure good flow through the stack cannot be maintained. An operable vent diameter is in the range from 8" (inches) to 10".

The afterburner chamber is provided with adjustable auxiliary air vents 32 through which fresh air is introduced to supply the necessary oxygen for complete combustion of the vapor flowing through the flame of the afterburner. The combustion gases from the afterburner chamber 26 flow upwardly through a stack 34 and are vented to the atmosphere.

As already pointed out, our system relies on sustaining a fire under controlled conditions in the main chamber so as not to trigger an explosion. However, to complete a "burn" of the charge within a few hours, usually from 4 to 6 hr, and generally no more than 8 hr, each cycle is completed within a period close to the minimum. Under such conditions the risk of an explosion is increased. Accordingly, as a precautionary measure, the furnace 10 is provided with an explosion control escape hatch 35 shown in phantom outline in an open position, and an escape hatch enclosure 36 which is vented to the atmosphere through a stack (not shown).

Figure 2:
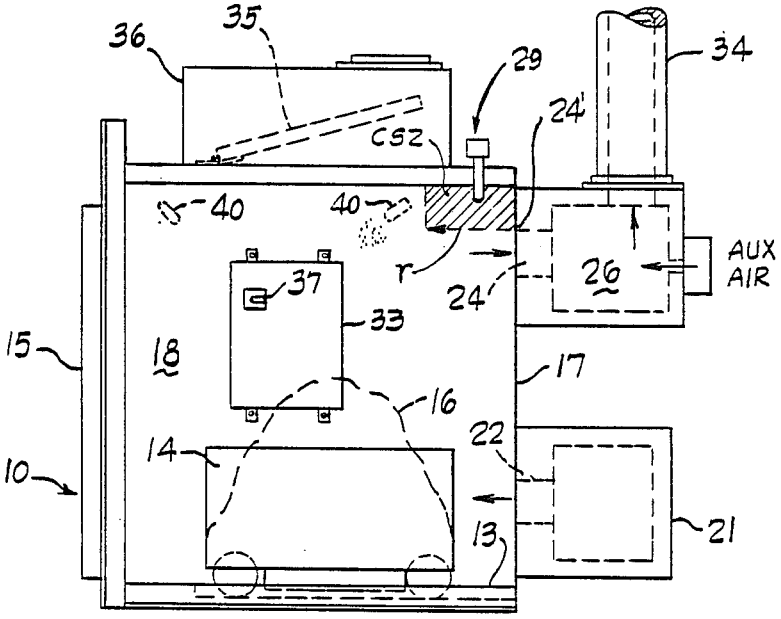
FIG. 2 is a side elevational view of the furnace showing the preferred locations in the furnace of the single thermocouple (zone TC) essential to the effective operation of the furnace with the control system.

Under such conditions, we discovered that not only is there a surprising difference in the ambient temperature in the main chamber 12 and that in the throat 24, but that controlling the temperature in the CSZ provides a smokeless, yet controlled and explosion-free burn. The CSZ is a lateral zone bounded by the ceiling of the main chamber and a lateral plane no lower than about 6 ins below the ceiling, from which lateral zone a vertical half-cylindrical section is circumscribed, the radius of this section being about 1 foot, and the center being the uppermost point from the center of the throat. In FIG. 1, the center of the CSZ is 24', the point where the vertical axis of the throat intersects its circumference. In FIG. 2, the radius of the half cylindrical section is indicated by r. Thus the CSZ lies in the zone above the locus of the radius liner in the horizontal plane.

Though we know of no single criterion for anticipating when an explosion will occur during a cycle, we have found that programming the controlled upward ramping of temperature, optionally with intermediate soak intervals, avoids an explosion while incinerating a high-polymer load smokelessly.

It is essential to provide a single TC 29 (T/C-1 in FIG. 4) only in the critical zone, identified in FIG. 1 as CSZ, being the shaded area in phantom outline. This TC, referred to as "the zone TC" senses the instantaneous temperature and conveys an electrical impulse corresponding thereto to the programmable controller PC which controls the progression of temperature (that is, the temperature profile of the ramp and soak periods over a single cycle) in the CSZ. Actuation of the water spray, as well as attenuation or on/off operation of the main burner, sufficient to ensure that the temperature sensed in the CSZ conforms to the profile, and therefore, the entire progress of the burn, may be controlled by the zone TC 29 in conjunction with the PC.

The PC preferably has 3 outputs and 1 temperature input where both primary and secondary water spray systems are desired. Typically, ouput #1 actuates the primary water spray system; alarm #1 actuates the secondary water spray system; and alarm #2 controls the temperature in the CSZ, and the temperature in the main chamber acquires a temperature profile unique to the main chamber's design.

The T/C-1 transmits signals to control means 37 mounted on an electrical panel 33 wall, shown mounted on the right side wall 18, and controls the burn-out of a charge as described hereinafter.

By controlling only the ramped temperature, that is, the instantaneous temperature sensed by the zone TC 29 (T/C-1) as a function of time, we are able to monitor, the instantaneous mass flow of vapor and combustion gases through the throat. When the temperature sensed by T/C-1 exceeds a predetermined temperature at a particular instant, (that is, the temperature lies above the profile or gradient of the programmed ramp and soak progression set by the PC), an appropriate reduction of the temperature is called for by the PC. A commercially available PC for the purpose is a West 2050 Series available from Gulton Industries, Inc.

The PC actuates a water spray means which sprays water on the burning load through nozzles 40 disposed within the main chamber, near the top thereof. If the temperature nevertheless exceeds a pre-set deviation which is above the profile of the ramp programmed by the PC, a further reduction in temperature is effected by a signal from the PC which actuates means for attenuating the main burner.

In a particular embodiment, a ramp and soak profile for a burn cycle may include (i) an initial soak period (referred to as $Dwell_i$); followed by (ii) a ramp which may, or may not be interrupted by one or more intermediate soak periods (referred to as $Dwell_{m1, \ldots m4}$); and, conclude with (iii) a final soak period (referred to as $Dwell_f$).

Typically, the PC is programmed for an initial soak temperature $T_i$ in the range from 600°-800° F. (say 650° F.) and the $Dwell_1$ is set for a preselected period in the range from 5 min to 30 min. The particular length of period for an initial soak is set by trial and error such as an operator is accustomed to do. Thereafter a ramp is set to raise the temperature from $T_i$ (650° F.) through a temperature gradient to $T_m$ (say 950° F.) with a $Dwell_m$ set for a period in the range from 3 to 10 hr (say 5 hr), then maintained at a final burn temperature $T_f$ in the range from 900°-1100° F. (say 950° F.) at the end of the ramp for a soak period ($Dwell_f$) set in the range from 2 to about 8 hr (say 5 hr). The precise periods and temperatures for the one or more ramps, and the initial, intermediate and final soaks, if such are desired, is set by trial and error, depending upon the type of load to be burned, the heat duty of the main burner and afterburner, and other variables.

If preferred, the ramp from $T_i$ to $T_m$ may be divided into one or more stepped intervals, allowing for a predetermined soak period $Dwellm_1$, $Dwe11_2$, etc. at each intermediate temperature $Tm_1$, $Tm_2$ etc.

Figure 3:
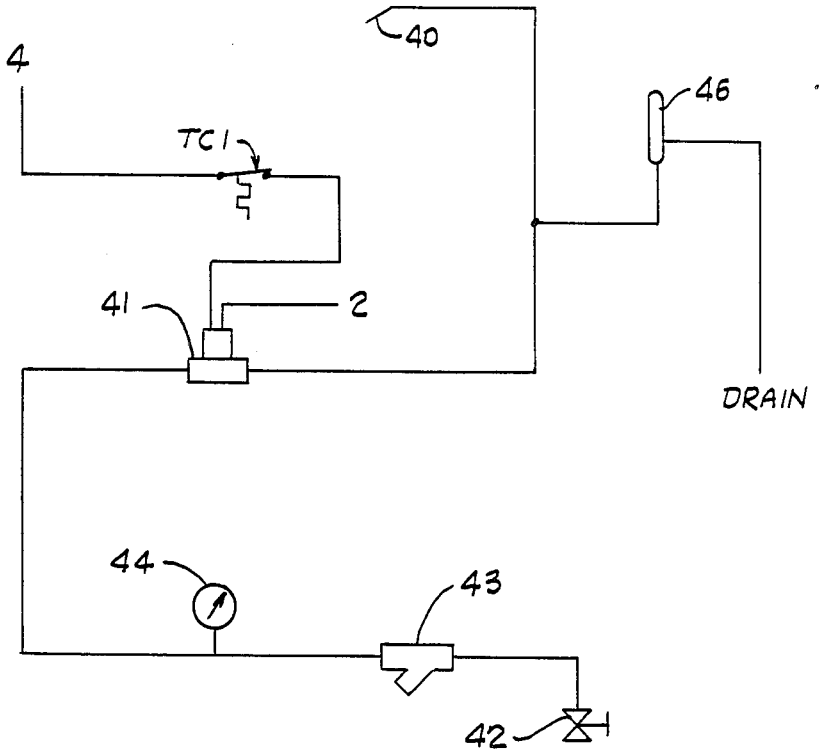
FIG. 3 is a diagrammatic illustration of a piping system for a water spray actuated by the control system for the furnace.

If the temperature set by the ramp profile is exceeded, a signal (output #1) from the PC turns the water spray on. If two water sprays are provided, the primary water spray system is turned on to control the ramp. In the primary water spray system, the spray nozzles' combined output depends upon the size of the main chamber, the size of a normal charge to be burned, and the amount of polymer to be burned. When the additional, second water spray means is used, it is also operated by the PC (alarm #1). Less than 1 gpm of water is typically adequate for the primary spray, from about 0.25-0.5 gpm being most preferred. The piping of the primary water system is schematically illustrated in FIG. 3 along with a portion of the electrical circuit for control of the solenoid 41.

Water from a water supply line under normal pressure of about 50 psig flows through gate valve 42 which is always open, then through strainer 43, and is stooped at the normally closed solenoid 41. A pressure gauge 44 senses line pressure. If the water pressure exceeds 175 psig it is relieved by a poppet type pressure relief valve 46. Upon signal from the zone TC 29 (T/C-1) the solenoid 41 opens and water is sprayed through the nozzles 40. When the temperature falls sufficiently, the water spray is stopped.

When the furnace is started, a relay in the burner is energized to start the blower motor. This closes the centrifugal switch on the motor and energizes the electronic ignition system. After a short delay, both the pilot valve and ignition are energized. Once the pilot is proven, the ignition is shut off and within one second the main valve opens. The afterburner stays on high fire for the complete cycle. When the setpoint on the zone TC is reached, the main burner goes off. The relay coil, main gas valve on the burner, and the pilot valve on the main burner are de-energized.

Figure 4:
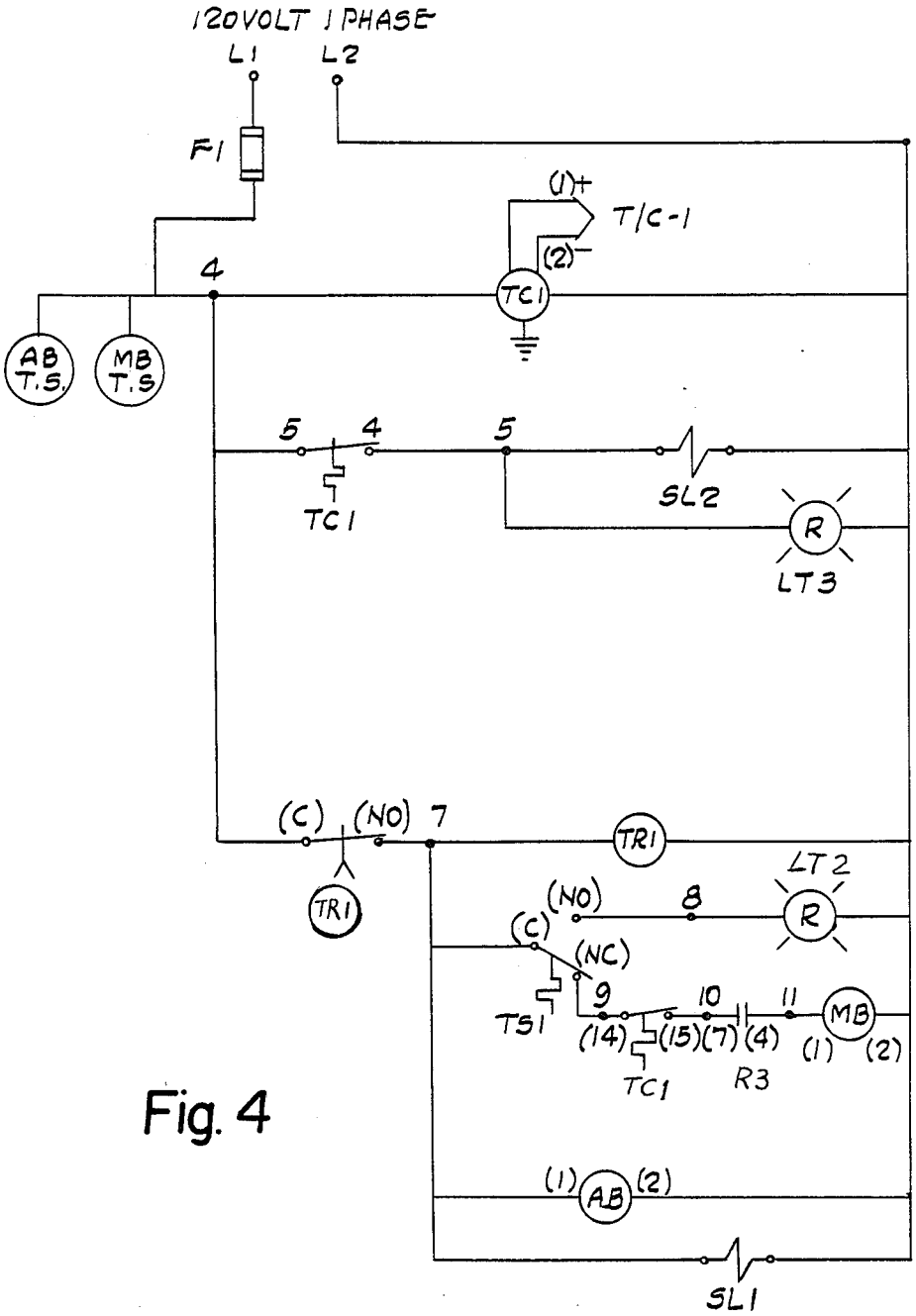
FIG. 4 is an electrical schematic for the control system.

Referring now to FIG. 4 there is shown a diagram for an electrical circuit for operation of the furnace with 120 volt (single phase) power supplied to terminals L1 and L2, the latter being neutral. The furnace is turned on with the timer TR1. With power at #7 the electrical circuit is energized. The cycle timer motor TR1 is now operating and the temperature controller TC1 (7 & 8) has power supplied to it. The gas shut-off solenoid SL1 will also be energized and actuate the gas valve (associated with the solenoid) to open it (the valve). The afterburner AB (1 & 2) will also be energized, go through its ignition sequence, and light up. The afterburner AB and gas solenoid SL1 will remain ON for the rest of the cycle.

As long as the furnace temperature remains below 1200° F., which is a preset temperature, power will flow through MB over-temperature control TS1 (C & NC). R3 closes which permits the main burner to come on. The main burner goes off when TC1 (14 & 15) opens.

When the furnace temperature exceeds 1200° F., MB over-temperature control TS1 contact (C & NC) will open and deenergize the main burner MB (1 & 2). Over-temperature control contact (C & NO) will close and the red high limit (over-temperature) light LT2 comes on. If, after having exceeded the preset temperature of 1200° F. the furnace temperature drops below 1200° F., MB over-temperature control TS1 must be manually reset. When switch TS1 is reset, contact (C & NO) opens and turns off the red over-temperature light LT2. Contact (C & NC) closes and supplies power to TC1 (14 & 15).

The main burner is controlled by the zone TC (T/C-1) which measures the temperature in the hottest zone in the furnace. The further away from the CSZ the TC 29 is located, the less accurately will it measure the hottest temperature in the main chamber. When the temperature in the CSZ is below a predetermined set-point, TC1 (14 & 15) closes and the main burner comes on. When the temperature in the CSZ exceeds the pre-set point, TC1 opens. Thermocouple T/C-1 is connected to the PC which is programmed with a $Dwell_1$ of 15 min. at 650° F.; a ramp from 650° F. to 950° over a period of 5 hr with no $Dwell_m$ because there are no intermediate soaking steps so that the profile of the ramp is a straight line with a gradient of 300° F. over 5 hr; and a $Dwell_f$ of 5 hr at 950° F.

When the temperature in the CSZ exceeds a point on the ramp and soak profile as set in the PC, the spray system solenoid will be energized, the red light LT3 goes on and the water valve associated with the solenoid is opened. Water is sprayed in a mist (or, finely divided stream of droplets) until the temperature in the CSZ and that in the main chamber drops below the set point and the water solenoid is de-energized.

The PC is provided with one or more set points corresponding to a deviation(s) which may be pre-set. For example, a first deviation of 25° F. is set in the PC which deviation is maintained over the profile of temperature of the entire cycle, so that if the temperature sensed by T/C-3 exceeds the instantaneous temperature on the profile by 25°, an additional event to help cool the load may be set-off. The main heat source (burner or electric resistance heating coil) may be shut off, or a second water spray (not shown) may be actuated. If two set-points are provided for two deviations, one deviation may be set for 25° F. (say) to actuate the second water spray, and the other deviation may be set for 50° to shut off the main heat source, or to trigger an alarm. Still another alterheat native is to use a single set-point for a deviation to actuate the second water spray as well as shut off the main heat source.

At the end of the cycle, the cycle timer contacts TR1 (C & NO) will open and de-energize the circuit. The furnace is shut off.

Though the heat source referred to hereinabove has, in the main, been a gas burner, an electric heat source such as resistance heating rods of nickel-chrome alloy sheathed with inconel may also be used with surprising effectiveness provided they glow red hot at sufficiently high temperature to ignite the vapors generated by the load. Typically, the heating rods are operated with an on/off switch to heat the load with a predetermined ramp, with or without a preliminary soak. The advantage of the heating rods is that the load may be brought up to the final soak temperature more quickly than with a main gas burner. In other words, the load may be burned with no preliminary soak and a steeper gradient of the ramp.

From the foregoing description of the best mode of operating the furnace it will be seen that (a) providing a smokeless stack even when burning a high-polymer load without damaging the metal parts, and (b) avoiding an explosion, are predicated on sustaining a fire in the mass of parts in the main chamber and closely controlling the temperature in the CSZ to track a predetermined temperature profile of ramp and soak periods required by the PC. The effectiveness of the control system is based on control of the ramp and soak periods by the PC operatively connected with the zone TC. Because the sensitivity of the zone TC was not known, its effect on controlling the safe and smokeless operation of a pyrolysis furnace safely was not appreciated.

We claim:

1. In a pyrolysis furnace having a main chamber, a main gas burner to directly heat air ducted into said chamber, a throat near the top of the main chamber through which throat organic vapor volatilized by pyrolysis of polymer-bonded metal parts, leaves the main chamber, said throat having an area, and said main chamber having a volume which are related such that their ratio is always greater than the critical vent number 0.003/ft, an afterburner chamber provided with an afterburner to incinerate said organic vapor downstream of the throat, and, an exhaust stack through which incinerated vapor is vented, the improvement comprising, a single temperature sensing means ("zone TC"), located within a critical sensitive zone in the main chamber, near the top thereof, and within about 1 foot of the upper edge of the throat but outside the throat, to sense the ambient temperature of gases above the metal parts within the main chamber;

programmable controller (PC) means including a temperature control means operatively connected to said zone TC to provide a predetermined temperature profile as a function of time and an instantaneous critical temperature, at any time within a burn cycle; and, water spray means responsive only to said zone TC and PC when the zone temperature exceeds said predetermined instantaneous critical temperature in the range from about 600°-1100° F., so that water is sprayed into the main chamber above said metal parts to lower said zone temperature below said required temperature;

whereby said incinerated vapor leaving said exhaust stack is permeable to light in the visible wavelength range.

2. The pyrolysis furnace of claim 1 wherein said programmable controller includes means to provide an initial soak period $Dwell_i$ at an initial soak temperature $T_i$ in the range from ambient to about 800° F., followed by a ramped temperature in the range from $T_i$ to an upper soak temperature $T_f$ in the range from about 900° F. to about 1100° F., said ramped temperature being interrupted by from 0 to 4 stepped soak periods at progressively higher temperatures; and, means to actuate a water spray means in said main chamber to cool said load to a temperature on said profile.

3. The pyrolysis furnace of claim 2 wherein said programmable controller includes a setting for a predetermined deviation of temperature in excess of said temperature profile, and, plural control means actuated by said zone TC include a control means, responsive to a signal generated by said PC, to attenuate or shut off the main burner when said predetermined deviation of temperature is exceeded.

4. The pyrolysis furnace of claim 3 wherein, said water spray is in the form of finely divided droplets which upon forming steam simultaneously lowers the temperature in the main chamber and increases the mass flow of vapor through said throat without triggering an explosion.

5. The pyrolysis furnace of claim 5 wherein the ratio of the weight of the load (lb)/volume of the main chamber ($ft^3$) is in the range from about 0.5 to about 15 $lb/ft^3$; and the weight ratio of burnables/metal in the load is in the range from about 0.1 to about 2.

6. A method for operating a pyrolysis furnace with essentially no visible smoke emanating from its stack, said furnace having a throat near the top of its main chamber in which a load is to be pyrolized, comprising, (i) maintaining a fire in a high-polymer load of metal parts being pyrolized under a controlled predetermined temperature profile including a progessive increase of temperature as a function of time, (ii) sensing the temperature with a single thermocouple in a critically sensitive zone with about 1 foot from the upper edge of the throat, but outside the throat, so as to obtain a required temperature as a function of time, and, (iii) actuating a water spray means when said required temperature is exceeded, to cool said load to a temperature below said profile; so that products of combustion from the stack are essentially smokeless.

* * * * *